US005419022A

United States Patent [19]

Linz

[11] Patent Number: 5,419,022

[45] Date of Patent: May 30, 1995

[54] APPARATUS FOR SPIN-DRAWING THERMOPLASTIC FILAMENT YARNS

[75] Inventor: Hans Linz, Kriens, Switzerland

[73] Assignee: Rhone-Poulene Viscosuisse SA, Switzerland

[21] Appl. No.: 70,394

[22] PCT Filed: Oct. 7, 1992

[86] PCT No.: PCT/CH92/00203

§ 371 Date: Jun. 7, 1993

§ 102(e) Date: Jun. 7, 1993

[87] PCT Pub. No.: WO93/08320

PCT Pub. Date: Apr. 29, 1993

[30] Foreign Application Priority Data

Oct. 15, 1991 [CH] Switzerland ..... 3023/91

[51] Int. Cl.[6] ..... D01D 5/16; D02J 1/22

[52] U.S. Cl. ..... 28/245; 28/244; 264/210.7; 264/210.8; 264/290.5; 264/291; 425/66

[58] Field of Search ..... 425/72.2, 377, 382.2, 425/464, 66; 264/210.8, 211.14, 210.7, 290.5, 291; 28/244, 245

[56] References Cited

U.S. PATENT DOCUMENTS

| | | | |
|---|---|---|---|
| 3,604,659 | 9/1971 | Jaeggli | 264/290.5 |
| 3,902,833 | 9/1975 | Matovinovic | 425/72.2 |
| 3,978,192 | 8/1976 | Sussman | 242/35.5 R |
| 4,293,518 | 10/1981 | Bethay, Jr. | 264/210.2 |
| 4,461,740 | 7/1984 | Koschinek et al. | 264/210.8 |
| 4,522,774 | 6/1985 | Donnelly et al. | 264/210.8 |
| 4,774,042 | 9/1988 | Schippers | 264/210.8 |

FOREIGN PATENT DOCUMENTS

| | | | |
|---|---|---|---|
| 3-199405 | 8/1991 | Japan | 264/211.14 |

*Primary Examiner*—Jay H. Woo
*Assistant Examiner*—Joseph Leyson
*Attorney, Agent, or Firm*—Seidel Gonda Lavorgna & Monaco

[57] ABSTRACT

In an apparatus for the spin-drawing, on multiple ends, of thermoplastic filament yarns on at least two pairs of godets (1, 2 and 1', 2'), their axes of rotation (7 and 8) are arranged skew with respect to each other in such a way that the axis of rotation (8) of the one godet (2) is arranged to be able to pivot within a plane (12) and the plane (12) forms an angle ($\beta$) of 10°-60° with the plane (10). The arrangement according to the invention makes it possible for the first time to spin and simultaneously draw in an integrated manner on multiple ends.

15 Claims, 4 Drawing Sheets

APPARATUS FOR SPIN-DRAWING THERMOPLASTIC FILAMENT YARNS

FIELD OF THE INVENTION

The invention relates to an apparatus for spin-drawing at least two thermoplastic filament yarns on at least two pairs of godets, each comprising two rotatable godets, of which at least one godet is driven and their axes of rotation lie skew with respect to each other and are arranged in such a way that the axis of rotation of the one godet is arranged to be able to pivot within a plane and this plane forms an angle with another plane.

BACKGROUND OF THE INVENTION

To spin-draw thermoplastic filament yarns such as polyesters, polyamides and the like, drawing devices having two or more pairs of rolls or godets (DE-A 1 907 782) are used. The axes of rotation of the rolls within the godet pair units are slightly inclined to each other to produce a certain winding pitch of the laid-on thread. Accordingly, the two axes of rotation lie within a common plane. Any change in the winding pitch required can easily be undertaken by changing the angle which the two axes of rotation together form.

It is also known that in a pair of godets, the axes of rotation of the two godets can be pivoted within two different planes, which are parallel to each other, perpendicular to the line connecting the godet axes.

It has been shown that neither the one nor the other of the described axial arrangements is optimal for the simultaneous spin-drawing of more than one thread.

It has been found that the winding pitch of the thread loops on one pair of rolls becomes smaller, the further the filament yarn is laid on towards the front, free end of the rolls. When only one filament yarn is being handled on a drawing frame, this is not of importance. When two or more filament yarns are handled simultaneously, a systematic reduction takes place in the spacings between the thread loops laid on parallel to each other the pair of godets. This reduction propagates itself to each downstream pair of godets, so that when three or more pairs of godets are used, the spacings between the filament yarns become so small that they can no longer be separated or no longer be sufficiently separated from each other. In the spin-drawing of multifilaments, it can moreover occur that individual fibrils from a filament yarn cross over to the neighboring filament yarn; as a result, differences in linear density are caused in the filament yarns which are produced simultaneously in this manner. Furthermore fibril breaks or thread breaks are caused by this on the drawing frame, which influences both the filament yarn quality and the economic efficiency of the process.

SUMMARY OF THE INVENTION

The object of the invention is to provide an apparatus for spin-drawing two or more filament yarns, which apparatus ensures the maintenance of a sufficient spatial separation between the individual yarn loops on the pairs of godets.

The object is achieved according to the invention in that the angle $\beta$ is 10°–60°.

The axes of the respective godets belonging to a pair of godets are arranged to be able to pivot with respect to each other in such a manner that the pivoting plane of a godet axis forms an angle of intersection $\beta$ with the plane joining the godet axes which contains both the center of this axis and the other godet axis.

It has been shown that the decrease in the winding pitch is dependent on the choice of the angle of intersection $\beta$. If the godets are arranged in such a way that the pivoting planes of their axes are perpendicular to the joining plane, angle of intersection $\beta=90°$, this decrease is considerably more greatly expressed than when the godet axes are arranged to pivot within the common joining plane. However, the decrease in the winding pitch is surprisingly not monotonic, but passes through a minimum.

It is expedient, within a multi-stage drawing frame having more than two pairs of godets, to arrange all pairs of godets in such a way that a sufficient spatial separation of the thread wraps is ensured.

A working width of the godets of 250 mm to 400 mm, in particular of 250 mmm to 350 mm, has the advantage that a plurality of threads can be handled simultaneously and a plurality of wraps can be laid on to the pair of godets. Working widths this large can only expediently exploited using the arrangement according to the invention of the axes of rotation of the godets.

BRIEF DESCRIPTION OF THE DRAWINGS

The invention shall be described in more detail on the basis of drawings. In which.

DETAILED DESCRIPTION OF THE INVENTION

Figure 1:
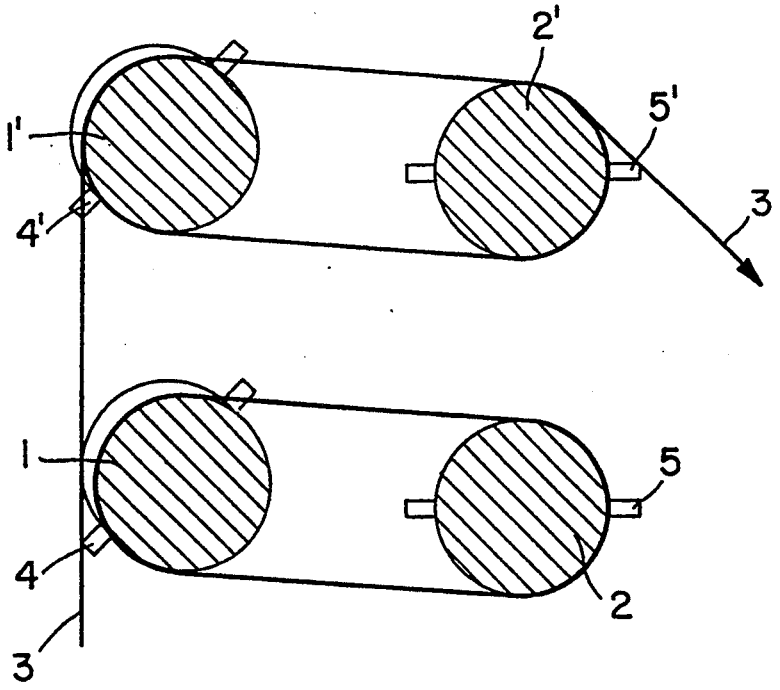
FIG. 1 shows the arrangement according to the invention of the godets in a drawing frame

In FIG. 1 a first godet of two pairs of godets is depicted with the designation 1 to 1'. The second godet of the pair of godets is depicted 2 to 2'. A filament yarn 3 is led over the pairs of godets 1, 2 and 1', 2'. Pairs of pivots 4–4' and 5–5' are provided for suspending the godets in the drawing frame.

Figure 2:
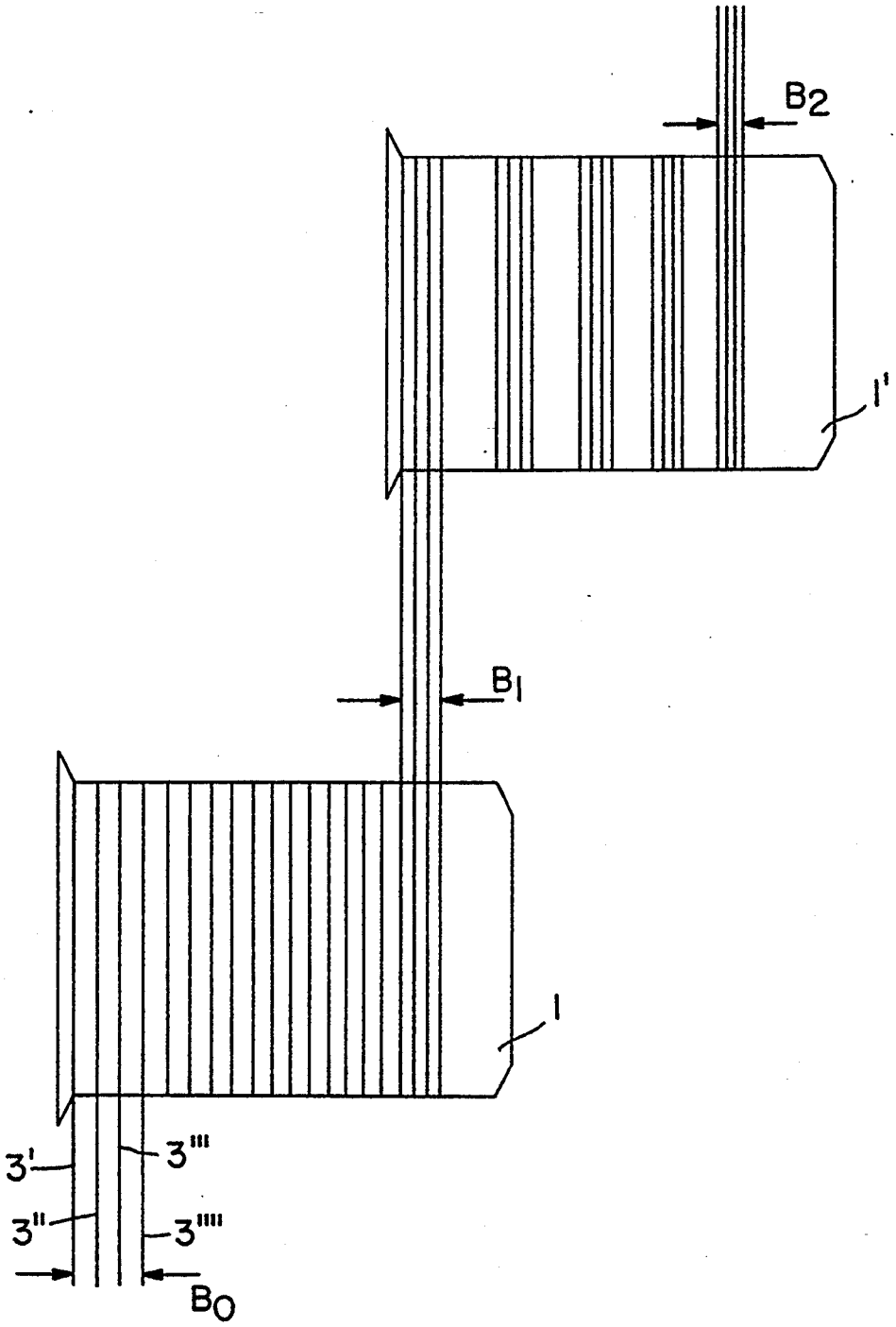
FIG. 2 shows a side view of two pairs of godets with the thread line

In FIG. 2, the pairs of godets 1, 2; 1', 2', are represented in side view, only the godet 1 of the pair of godets 1, 2 and the godet 1' of the pair of godets 1', 2' being visible. A filament yarn set 3, composed of the filament yarns 3', 3'', 3''', 3'''', is laid on godet 1, coming from underneath, and leaves godet 1' after respective 5-fold looping of both pairs of godets. $B_0$ denotes the width of the yarn sheet at the feed onto the godet 1, $B_1$ denotes the width of the yarn sheet on leaving the godet 1 and $B_2$ denotes the width of the yarn sheet on leaving godet 2.

Figure 3:
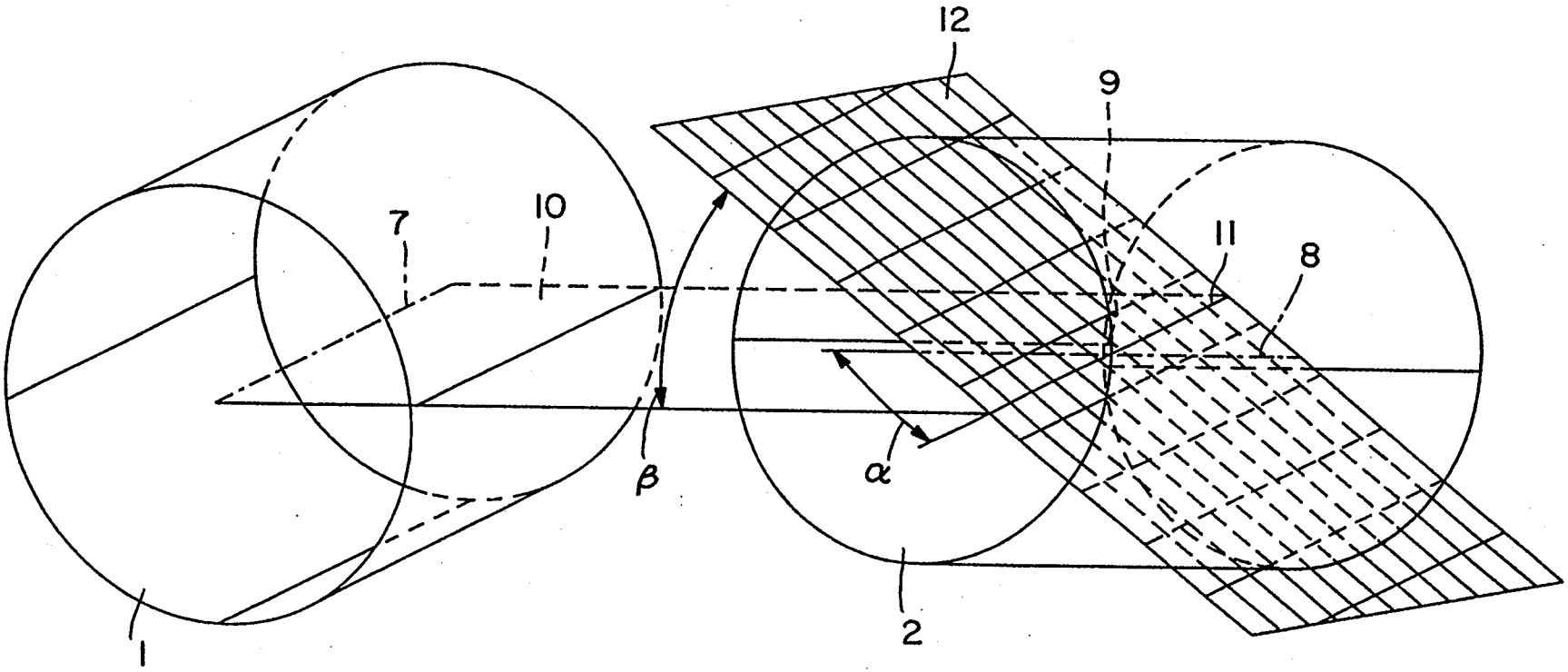
FIG. 3 shows a spatial representation of the axial arrangement according to the invention

In FIG. 3, the godets 1 and 2 are represented three-dimensionally. Godet 1 is rotatably mounted about an axis of rotation 7. Godet 2 is rotatably mounted about an axis of rotation 8. The axes of rotation 7 and 8 are skew with respect to each other, that is they do not have an intersection point even in elongation thereof. A plane 10 is defined by the axis of rotation 7 and the center 9 of the axis of rotation 8. The parallel 11 to the axis of rotation 7 through the center 9 is the line of intersection between the plane 10 and a plane 12. The two planes 10 and 12 intersect each other at an angle $\beta$. Within the plane 12, the axis of rotation 8 forms an angle of intersection $\alpha$ with the parallel 11.

In operation, the respective godets 1 and 1' and 2 and 2' which are combined to form a pair of godets are mounted to be able to pivot on a pair of pivots 4 and 4' and 5 and 5'. Although the pairs of pivots 4 and 4' and 5 and 5' are arranged in parallel within each pair, they are not arranged in parallel between each pair. As a result, it is achieved that the pivoting planes of the godets 1 and 1' form an angle of intersection with the joining planes.

This could equally well be achieved by offsetting vertically to each other the respective godets belonging to a pair of godets. An arrangement of the godets which is vertically offset with respect to each other would considerably increase the height of the machine and make its operation disproportionately more difficult. The depicted suspension of the godets on pairs of pivots is exemplary and is only one of the possible technical solutions for realizing the invention. The spatial orientation of the axes of rotation of the godets with respect to each other is essential for the invention.

The yarn sheet 3, coming from undepicted feed rolls, winds vertically from below onto the godet 1. After one or more loops, the yarn sheet 3 leaves the pair of godets 1, 2 again from the godet 1 and impinges at the godet 1' on the pair of godets 1', 2', wound round which are likewise single or multiple loops. The filament yarn yarn sheet 3 can then either be fed to one or more further pairs of godets or directly to a winding-up device.

In FIG. 2, the yarn sheet, composed of the four filament yarns 3', 3'' 3''' and 3'''' which are conducted in parallel to each other, coming from below, winds on, in the vicinity of the drive-side edge, to the godet 1 of the pair of godets 1, 2. It loops round the pair of godets 1, 2 five times, all threads being laid in accordance with the winding pitch, which is produced by the godet 2 (not visible), up to the vicinity of the free right godet edge. The threads of the yarn sheet 3 are then fed to the godet 1' of the pair of godets 1', 2', wound round which in the same manner are five loops.

The depiction of four filament yarns is to be taken as exemplary and without restriction. The object achieved according to the invention applies by analogy to any number of threads greater than or equal to 2. The lines depicted only indicate the zones on the godet periphery on which the filament yarns 3', 3'', 3''' and 3'''' are positioned. The lateral expansion of the filament yarns is not depicted. Only for reasons of clarity are the outer of the four filament yarns shown 3' and 3'''' drawn more heavily than the inner filament yarns 3'' and 3'''.

The axis of rotation of the undepicted second godet is pivoted with respect to the first in such a way that the desired winding pitch of the filament yarns is achieved. The decrease in winding pitch along the godet axis from wind-on zone to take-off zone may be clearly recognized. The original overall width $B_0$ of the yarn sheet 3, which occurs at the feed, reduces to the width $B_1$ at the take-off. The width of the yarn sheet 3 is taken to mean the distance between the centers of gravity of the first and last of the filament yarns conducted over the pair of rolls. Let the arithmetic ratio $B_1/B_0=SW$ be termed the separation efficiency below. This parameter represents a measure for the relative decrease in the width of the filament yarn yarn sheet 3 within a pair of drawing rolls.

It has been shown that the separation efficiency is of central importance. If namely the yarn sheet 3 is conducted in the same manner over a second pair of godets of the same configuration, $B_1$ represents there the feed width of the yarn sheet. It is reduced to the width $B_2$ on the path over the second pair of godets in the same manner as was previously the feed width $B_0$ to $B_1$. The equation $B_2/B_1=B_1/B_0=SW$ resulted. From this it can be deduced that on the path over n pairs of godets of similar type, the original width $B_0$ of the yarn sheet is reduced to $B_n=B_0*SW_n$.

EXAMPLES

The mode of action of the invention can be described on the basis of the following examples.

Example 1

Figure 4:
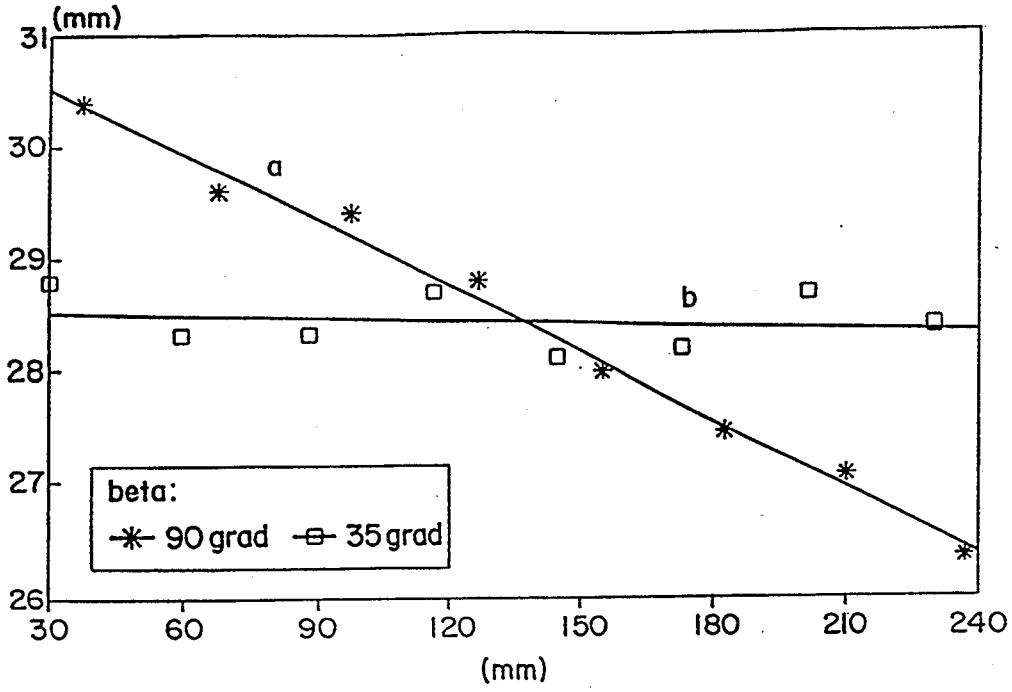
FIG. 4 shows a graphic representation of the winding pitches on a pair of godets as a function of the axis coordinate and the angle $\beta$.

Two rotating godets of length 300 mm and diameter 190 mm are combined to form a pair of godets. The axis of rotation of the godet 1 is orientated skew to the axis of rotation of the godet within the plane 12. The angle of intersection $\beta$ between the planes 10 and 12 is 90°. The pair of godets 1, 2 is looped round by a thread five times. The winding pitch between the individual loops decreases on the pair of godets 1, 2 from wind-on to take-off from 30.5 mm by 4 mm to 26.5 mm. The winding pitch is depicted graphically in relation to the axial coordinate in FIG. 4, curve a.

Example 2

The godet arrangement according to Example 1 is modified in such a way that the angle of intersection between the plane 10 and the plane 12 is 35°. In this case, the decrease in the winding pitch along the godet axis is less than 1 mm. The winding pitch is depicted graphically in relation to the axial coordinate in FIG. 4, curve b.

Example 3

A pair of godets as in Example 1 is looped round by four filament yarns five times on its entire working width. The winding pitch of the first thread wrap of the first thread is 77 mm. The second, third and fourth threads are positioned at equal spacings within this first wrap. From this results a center of gravity spacing between the first and the fourth thread of $B_0=58$ mm. This spacing reduces up to the take-off point of the threads of this pair of godets to $B_1=24$ mm. A separation efficiency SW of 0.41 follows from this, that is the original width of the yarn sheet is reduced to 41%. On a downstream second pair of drawing godets of the same type, this spacing, as a result of the separation efficiency SW=0.41, would be further reduced to 10 mm. In the case of a thread spacing of at least 1 mm, which is required for safe operation, using such a godet pair configuration, only fine filament yarns having a width of no more than 2 mm can be handled. on a further third pair of godets, the spacing would be decreased to the extent that the threads would virtually no longer be distinguishable from each other.

Example 4 (Comparison Example)

Two rotating godets of length 300 mm and diameter 190 mm are, as in Example 3, looped round by four filament yarns five times. The axes of the two godets are not orientated skew with respect to each other, but lie within a plane, that is the planes 10 and 12 are coplanar, the angle of intersection $\beta$ is equal to 0. The winding pitch of the first thread wrap of the first thread is 58 mm. The second, third and fourth threads are positioned at equal spacings within this first wrap. A distance between the centers of gravity of the first and fourth threads of $B_0=43.3$ mm results from this. This distance reduces up to the take-off point of the threads of this pair of godets to $B_1=34.8$ mm. A separation efficiency SW of 0.804 follows from this. On a downstream second pair of drawing godets of the same type, this distance further reduces to $B_2=28$ mm. Even after passing the four pairs of godets of the same type, a yarn sheet width of $B_4=18.1$ mm still remains. Under the boundary condition that a thread spacing of at least 1 mm must be ensured for safe operation, this gives the possibility still of separating threads of width 5 mm and of feeding them to their individual winding-up stations.

Examples 5 to 12

Figure 5:
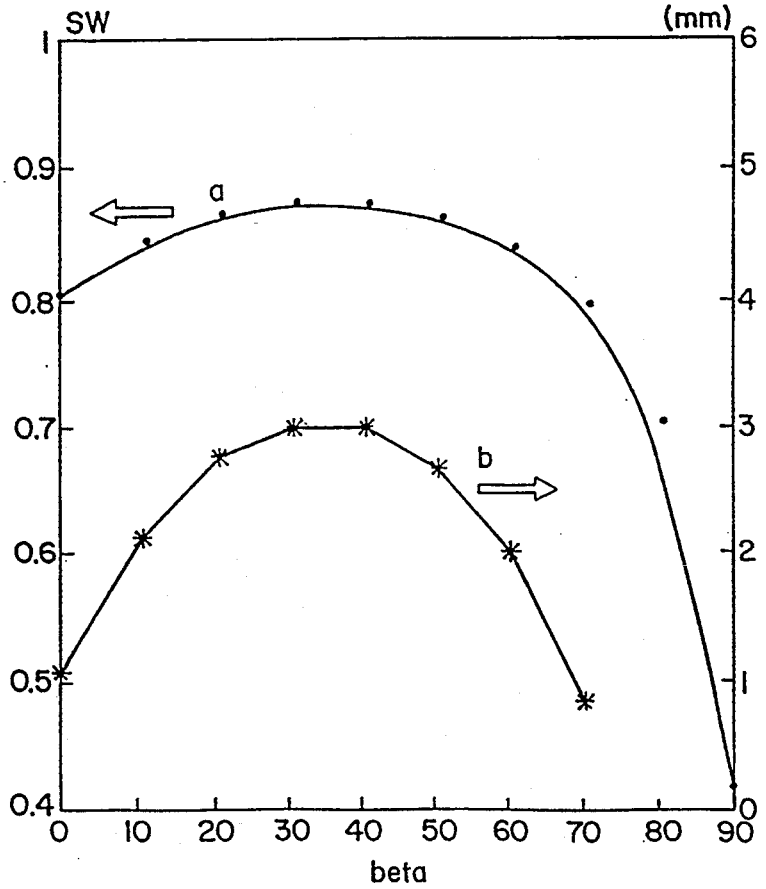
FIG. 5 shows a graphic representation of the relationship of the separation factor and of the resulting spacing between the threads to the angle $\beta$.

Two rotating godets of length 300 mm and diameter 190 mm are, as in Example 3, looped round by four filament yarns five times on their entire working width. The axes of the two godets are skew with respect to each other. Their mutual orientation is varied in such a manner that the angle of intersection between the planes 10 and 12 assumes different values between 10° and 80°. The influence of the angle of intersection $\beta$ on the width of the yarn sheet $B_0$ at the feed and $B_1$ at the delivery of the pair of godets was determined and the separation degree SW was calculated therefrom. The results are compiled in Table 1 together with those of the Examples 3 and 4. It can be seen from this that the values for the separation degree SW do not change monotonically with the angle of intersection but pass through a maximum. In FIG. 5, curve a, this course is depicted graphically.

In the knowledge of the abovementioned function, $B_n=B_0*SW^n$, by which the width of the yarn sheet further reduces on further pairs of godets, the bundle width $B_4$ on leaving a fourth identically-configured pair of godets was calculated for the range $0°\leqq\beta 70°$, as were the resulting spacings between the filament yarns of 5 mm width to be processed. These results are also listed in Table 1. It is seen that in particular the spacings between the filament yarns within the angle range $10°\leqq\beta\leqq 60°$ are at least twice as large as those outside. A significantly higher operational safety is achieved by this. Individual filaments of a filament yarn are also prevented from crossing over to the adjacent filament. As a result of the greater spacings between the filament yarns, the handling is considerably facilitated.

TABLE 1

| Example No. | Angle of intersection $\beta$ | B0 [mm] | B1 [mm] | Separation efficiency SW | B4 [mm] | Thread spacing [mm] |
|---|---|---|---|---|---|---|
| 3 | 90 | 57.6 | 23.6 | 0.410 | | |
| 4 | 0 | 43.3 | 34.8 | 0.804 | 18.1 | 1.0 |
| 5 | 10 | 42.4 | 35.8 | 0.844 | 21.4 | 2.1 |
| 6 | 20 | 41.9 | 36.2 | 0.864 | 23.3 | 2.8 |
| 7 | 30 | 41.8 | 36.4 | 0.871 | 24.0 | 3.0 |
| 8 | 40 | 41.8 | 36.4 | 0.871 | 24.0 | 3.0 |
| 9 | 50 | 42.0 | 36.1 | 0.860 | 23.0 | 2.7 |
| 10 | 60 | 42.3 | 35.5 | 0.839 | 21.0 | 2.0 |
| 11 | 70 | 43.4 | 34.5 | 0.795 | 17.5 | 0.8 |
| 12 | 80 | 46.1 | 32.4 | 0.703 | | |

As follows from the figures of Table 1, the separation effect SW does not depend in a monotonic manner on the angle $\beta$ of the suspension of the pair of godets. In the studies, an angle range of $10°\leqq\beta\leqq 60°$ has surprisingly been found within which the separation effect SW passes through a maximum. Within this angle range, the resulting spacing between threads of width 5 mm are at least twice as large as is known after passing four pairs of godets.

The higher operating safety achieved as a result on the one hand produces an improved assurance of the quality of the filament yarn produced, and on the other hand, as a result, the transfer to simultaneous handling of two or more threads is made possible or at least facilitated. The result is a considerable increase in productivity of the spin-drawing process in comparison with the single-end process.

That which is claimed is:

1. An apparatus for spin-drawing at least two thermoplastic filament yarns comprising at least two pairs of godets, wherein at least one pair of the at least two pairs of godets comprises a first rotatable godet and a second rotatable godet, wherein said first and said second godets each have an axis of rotation, wherein said first and the second godets' axes of rotation lie skew with respect to each other, wherein said first and said second godets are arranged in such a way that said first godet's axis of rotation is pivotable within a first plane passing through said first godet's axis of rotation, wherein said first plane forms an angle of intersection ($\beta$) with a second plane, wherein said second plane is defined by said second godet's axis of rotation and the center of said first godet's axis of rotation, and wherein the angle of intersection ($\beta$) ranges from between 10°–60°.

2. The apparatus as claimed in claim 1, wherein said second godet's axis of rotation is pivotable within said second plane.

3. The apparatus as claimed in claim 1, wherein said first and said second godets each have a working width ranging from between 250 mm–400 mm.

4. An apparatus for spin-drawing at least two thermoplastic filament yarns comprising at least two pairs of godets, one pair of the at least two pairs of godets comprises a first rotatable godet and a second rotatable godet, wherein said first and said second godets each have an axis of rotation, wherein said first and said second godets' axes of rotation lie skew with respect to each other, wherein said first and said second godets are arranged in such a way that said first godet's axis of rotation is pivotable within a first plane passing through said first godet's axis of rotation, wherein said first plane forms a first angle of intersection ($\beta$) with a second plane, wherein said second plane is defined by said second godet's axis of rotation and the center of said first godet's axis of rotation, and wherein the first angle of intersection ($\beta$) ranges from between 10°–60°, and another pair of the at least two pairs of godets comprises a third rotatable godet and a fourth rotatable godet, wherein said third and said fourth godets each have an axis of rotation, wherein said third and said fourth godets' axes of rotation lie skew with respect to each other, wherein said third and said fourth godets are arranged in such a way that said third godet's axis of rotation is pivotable within a third plane passing through said third godet's axis of rotation, wherein said third plane forms a second angle of intersection (β') with a fourth plane, wherein said fourth plane is defined by said fourth godet's axis of rotation and the center of said third godet's axis of rotation, and wherein the second angle of intersection (β') ranges from between 10°–60°.

5. The apparatus as claimed in claim 4, wherein said second godet's axis of rotation is pivotable within said second plane.

6. The apparatus as claimed in claim 5, wherein said fourth godet's axis of rotation is pivotable within said fourth plane.

7. The apparatus as claimed in claim 4, wherein said fourth godet's axis of rotation is pivotable within said fourth plane.

8. The apparatus as claimed in claim 4, wherein said first and said second godets each have a working width ranging from between 250 mm–400 mm.

9. The apparatus as claimed in claim 8, wherein said third and said fourth godets each have a working width ranging from between 250 mm–400 mm.

10. The apparatus as claimed in claim 4, wherein said third and said fourth godets each have a working width ranging from between 250 mm–400 mm.

11. The apparatus as claimed in claim 4, wherein the first angle of intersection (β) ranges from between 30°–40°.

12. The apparatus as claimed in claim 11, wherein the second angle of intersection (β') ranges from between 30°–40°.

13. The apparatus as claimed in claim 4, wherein the second angle of intersection (β') ranges from between 30°–40°.

14. The apparatus as claimed in claim 1, wherein the first angle of intersection (β) ranges from between 30°–40°.

15. An apparatus for spin-drawing at least two thermoplastic filament yarns comprising at least two pairs of godets, wherein at least one pair of the at least two pairs of godets comprises a first rotatable godet having a working width ranging from between 250 mm–400 mm and a second rotatable godet having a working width ranging from between 250 mm–400 mm, wherein said first and said second godets each have an axis of rotation, wherein said first and said second godets' axes of rotation lie in skew with respect to each other, wherein said first and said second godets are arranged in such a way that said first godet's axis of rotation is pivotable within a first plane passing through said first godet's axis of rotation, and that said second godet's axis of rotation is pivotable within a second plane, wherein said second plane is defined by said second godet's axis of rotation and the center of said first godet's axis of rotation, wherein said first plane forms an angle of intersection (β) with said second plane, and wherein the angle of intersection (β) ranges from between 30°–40°.

* * * * *